United States Patent [19]

Zaman

[11] Patent Number: 4,869,199

[45] Date of Patent: Sep. 26, 1989

[54] MANIFOLD FOR DISTRIBUTING WIRE COATING ENAMEL

[75] Inventor: Mohammad F. Zaman, Fort Wayne, Ind.

[73] Assignee: Essex Group, Inc., Ft. Wayne, Ind.

[21] Appl. No.: 83,763

[22] Filed: Aug. 10, 1987

[51] Int. Cl.[4] ..... B05C 11/02

[52] U.S. Cl. ..... 118/125; 118/405; 118/423; 427/356; 427/434.6

[58] Field of Search ..... 118/125, 405, 423; 427/356, 434.6

[56] References Cited

U.S. PATENT DOCUMENTS 4,622,242 11/1986 Mackay ..... 118/405

4,717,604 1/1988 Justus ..... 118/405 X

*Primary Examiner*—Bernard Pianalto

*Attorney, Agent, or Firm*—Kevin E. McVeigh; Edward L. Kochey, Jr.

[57] ABSTRACT

A manifold bar for supplying enamel to a die bar is disclosed. A manifold bar has internal passages which provide a flow path from an enamel supply to the feed holes of a die bar. A method for directing a flow of enamel from an enamel supply to a die bar is also disclosed.

2 Claims, 2 Drawing Sheets

MANIFOLD FOR DISTRIBUTING WIRE COATING ENAMEL

TECHNICAL FIELD

The field of art to which this invention pertains is wire coating apparatus.

BACKGROUND ART

Survival in the keenly competitive magnet wire marketplace requires large scale production of high quality product at low cost. There is an intense and continual effort in the industry to develop cost reducing process improvements to provide competitive advantage.

The typical process for producing magnet wire is a continuous three-step process.

In the first step, bare wire is annealed. Wire of a desired diameter is drawn from a supply through an annealing oven in order to soften it and increase its flexibility as required in the subsequent process steps.

In the second step, the bare wire exiting the annealing oven is coated with a layer of insulating enamel by, for example, passing through an open slip containing the enamel. The enamel used for insulating magnet wire is typically a polymer solution, such as a polyamide, a polyurethane, a polyester, or a polyimide, dissolved in an organic solvent or mixture of organic solvents, such as phenol and cresol. The coated wire passes through a die having a passage of a dimension to allow only the wire and a layer of insulating enamel adhering to the wire to pass through to form a coated wire.

In the third step, the enamel on the coated wire is dried and cured by heating. A vertical oven is typically used. A temperature gradient is maintained along the path of the coated wire being drawn through the oven. At the bottom where the coated wire enters, the temperature is maintained to allow the gradual evaporation of the organic solvents from the enamel. At the top end of the oven where the coated wire exits, a relatively higher temperature is maintained to cure the enamel. The wire exits the oven with a coating of cured enamel.

The insulated wire typically undergoes a series of coating steps as the insulation layer formed by one coating step is too thin for most applications. The insulated wire is taken from the oven and drawn through a second coating step. A second layer of insulating enamel adheres to the wire, which is then passed through a second die which has a passage of larger dimension than the first die, and drawn through the oven for drying and curing of the second layer. It should be noted that the second die functions in the same manner as the first die, and differs only in that its passage is of a slightly larger dimension than that of the first die. This allows for the thickness of the coating of the insulation to be increased by the second coating step.

This method of adding coatings to the wire may be repeated any desired number of times and requires only that successive dies have passages with progressively increasing dimensions to assure the formation of a progressively increasing thickness of insulation on the wire. The successive layers of enamel may be of different composition in order to take advantage of the unique properties of each of the enamel coatings.

The dies used in the coating step may be retained in a structure known as a die bar. Typically, the die bar is a rectangular bar having suitably formed holes within which individual dies may be secured. A bare wire from a feed spool or an insulated wire returning from the oven exit to be recoated is fed to a feed sheave situated below the die bar, passes upward through the die and the oven and is fed to a return sheave situated above the exit of the oven. The return sheave acts to receive the insulated wire exiting the oven and either return it to the feed sheave for subsequent recoating or feed the wire to a take-up spool where the fully insulated or product wire is wound.

The production of insulated magnet wire usually entails the simultaneous production of a plurality of separate wires each undergoing multiple passes through the process path. In this way several separate wires may be simultaneously produced to effect a savings in production time and energy. This method requires the use of a plurality of sheaves, and a plurality of dies, and perhaps a plurality of die bars.

While the benefits with regard to efficiency and energy savings of a multiple wire, multiple pass type operation should be apparent, the method is not without disadvantages. Adjusting the alignment of the die bars and guide sheaves as, for example, when it is desired to change dies, is a time-consuming process. Changing enamel materials is also a time-consuming process. The enamel supply system and the dies must be flushed with solvent to remove traces of the previous enamel. The need to dispose of flushing solvent further increases the cost of this technique. Further, if conditions require an adjustment of process parameters affecting one wire, the entire line must typically be shut down, greatly multiplying the cost of the adjustment.

What is needed in the art is a magnet wire coating apparatus and method which overcomes the above problems.

DISCLOSURE OF THE INVENTION

An object to the invention is to provide an enclosed enamel distribution system for directing a flow of enamel from an enamel supply to a die bar for use with high viscosity, high solids enamel.

Another object of the invention is to provide an enamel distribution system which allows independent control of the enamel supply to each die.

Another object of the invention is to provide an enamel distribution system which allows rapid changes between different enamel feeds to be made.

Another object of the invention is to provide an enamel distribution system which allows rapid changes between different die bars to be made and which automatically aligns die bars.

Another object of the invention is to provide an improved enamel distribution method, useful for coating magnet wires with enamel insulation.

A manifold bar for supplying enamel to a die bar is disclosed. The manifold bar has internal conduit within the bar, a supply passage communicating with the internal conduit and with the exterior of the bar for communication with an enamel supply, and a feed passage communicating with the internal conduit and the exterior of the bar for communication with a feed hole in a die bar.

Another aspect of the invention is a method for directing a flow of enamel from an enamel supply to a die bar by providing a manifold bar of the present invention.

The foregoing and other features and advantages of the present invention will become more apparent from the following description and accompanying drawings.

BEST MODE FOR CARRYING OUT THE INVENTION

Figure 1:
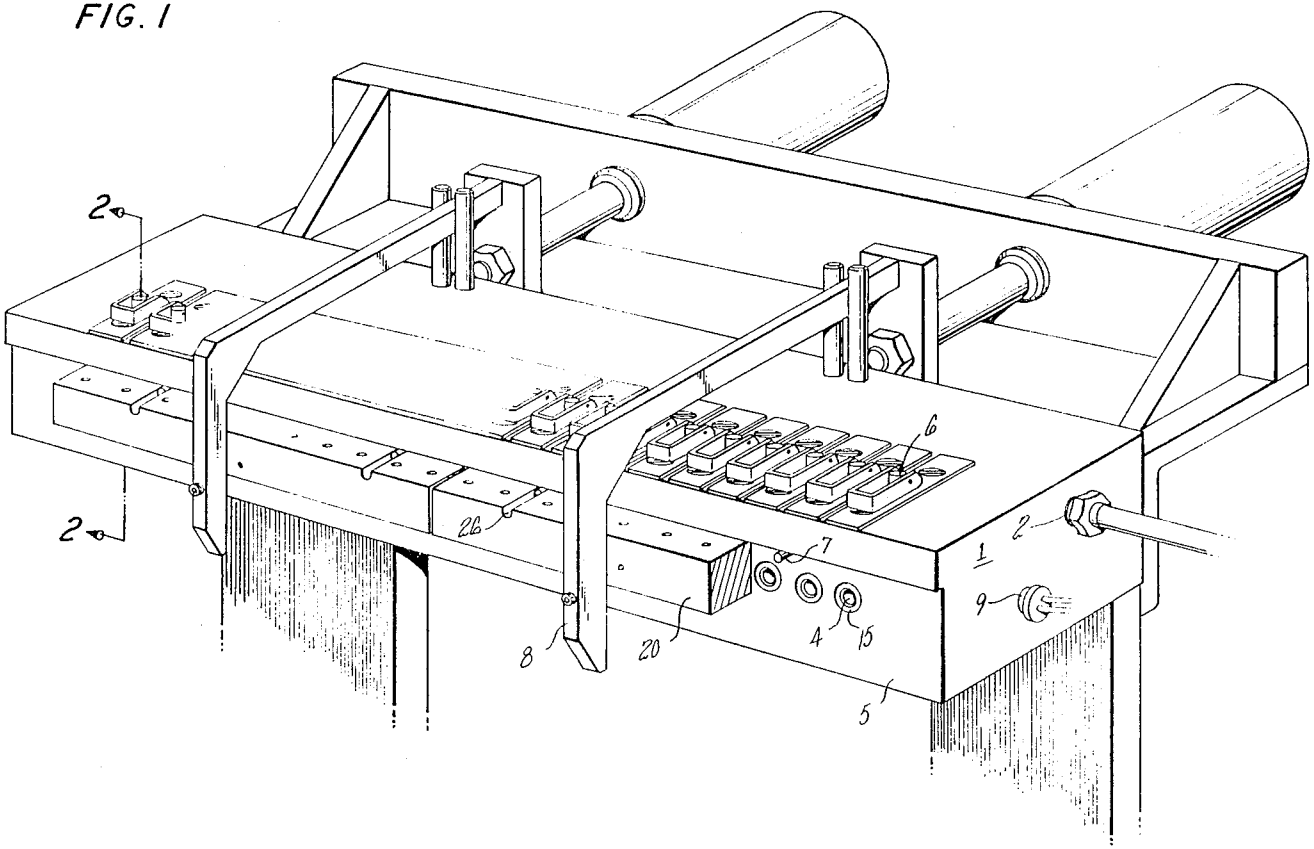
FIG. 1 shows a perspective view of a manifold bar of the present invention.
Figure 2:
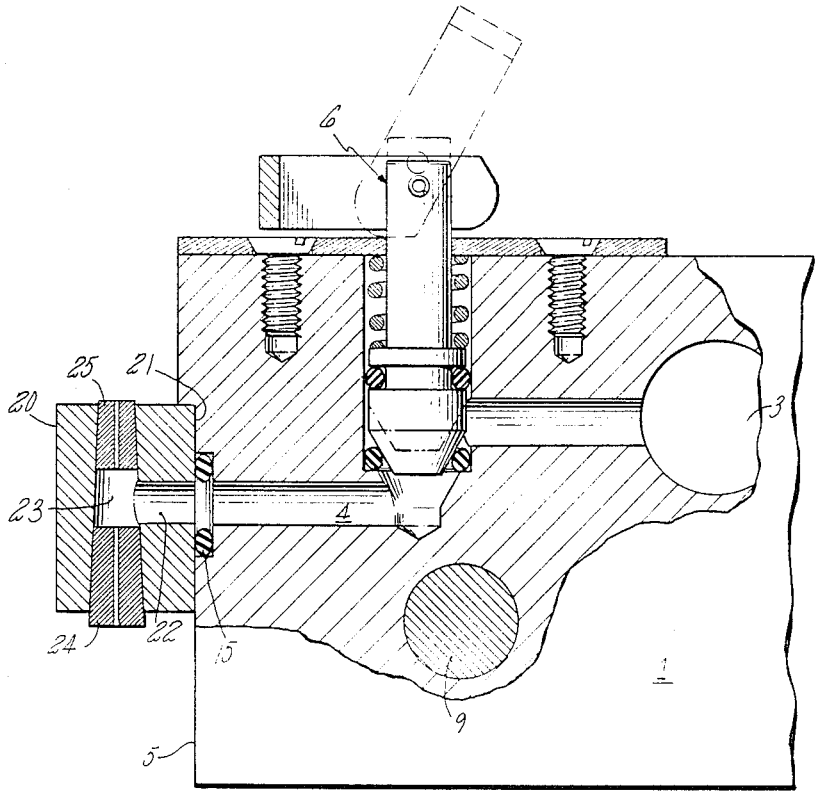
FIG. 2 shows a cross-sectional view of the manifold bar of the present invention.

The manifold bar of the present invention is shown in FIG. 1 and in FIG. 2.

The internal conduit (3) defines a void which runs longitudinally within the manifold bar (1). A supply port (2) which communicates with the internal conduit and with an external surface of the manifold bar is provided for connecting the internal conduit (3) to an enamel reservoir.

Feed passages (4) communicate with the internal conduit (3) and the flat proximal surface (5) of the manifold bar. A valve means (6) allows each of the feed passages to be opened or closed independently. The flat proximal surface (5) of the manifold bar contacts the flat distal surface (21) of the die bar (20). The feed passages (4) of the manifold bar are positioned to correspond to the feed passages (22) of the die bar (20) so that communication between each feed passage (22) of the die bar and a corresponding feed passage (4) of the manifold bar is established when the flat distal surface (21) of the die bar (20) is retained in alignment with the flat proximal surface (5) of the manifold bar (1). Gaskets (15) are provided at the interface to prevent leakage of enamel.

The die bar (20) has a plurality of die holes (23). A guide die (24) and a metering die (25) are retained in each die housing (23). A feed passage (22) communicates with each die housing (23) and with the flat distal surface (21) of the die bar.

The upper surface of each die bar (20) is provided with two transversely oriented recesses (26). Locator pins (7) for cooperation with the recesses (26) are provided on the flat proximal surface (5) of the manifold bar, to align the die bar with the manifold bar.

Retainer means, such as the clamp (8) retain the die bar (20) in fixed position relative to the manifold bar (1).

A thermocouple (not shown), embedded in the manifold bar (1), is provided so that the temperature of the manifold bar may be monitored and controlled. An electrical resistance heater rod (9) which runs longitudinally within the manifold bar is provided so that the temperature of the bar may be elevated above ambient temperature. Control of the temperature of the manifold bar is an important process variable because of the strong effect of temperature on the viscosity of the enamel.

A flow of enamel may be provided from an external enamel reservoir through the supply port (2) to the internal conduit (3) of the manifold bar. Enamel may then flow from the internal conduit (3) through each feed passage (4) in which the valve (6) is in the open position. From the feed passages (4) of the manifold (1) the enamel may flow through the feed passages (22) of the die bar (20) to the die housing (23).

The wire to be coated enters through the guide die (24), passes through the die housing (23) and exits through the metering die (25). When a sufficient flow of enamel is provided to the die housing, the wire emerges from the metering guide (25) coated with enamel.

Conventional magnet wire coating enamel supply systems typically provide an open enamel flow path, such as an open slip.

The enamel flow path from the enamel supply to the die is enclosed to prevent changes in the viscosity of the enamel due to the evaporation of solvent and to avoid contamination of the enamel with foreign matter.

Changing dies or changing enamels are typically laborious and time-consuming processes in a conventional magnet wire coating enamel supply system.

The modular design of the manifold bar of the present invention allows the die bar and manifold bar to be easily removed from the other elements of the enamel application system. The clamp allows rapid engagement and disengagement of the die bar and manifold bar. The cooperation of the locator pins on the manifold bar and corresponding recesses in the die bar align the die bar with the enamel application system without the conventional time-consuming alignment process. The manifold bar may be removed from the enamel application system as well. Once removed, the manifold bar and die bar may be cleaned by soaking in a remote solvent bath, rather than by the time-consuming process of solvent flushing while the bars are in place. By providing multiple manifold bars and die bars, the downtime associated with a change of enamel material may be limited to the relatively brief time period required to remove a manifold bar and die bar and to install a clean manifold bar and clean die bar rather than the relatively long time period required for the conventional flushing process.

Conventional systems require shutdown of a plurality of dies to allow the adjustment of the processing parameters which affect a single wire. The independent valve means associated with the enamel flow path to each die allows the selective shutdown of a single die to allow adjustment of the processing parameters which affect a single wire.

Although this invention has been shown and described with respect to detailed embodiments thereof, it will be understood by those skilled in the art that various changes in form and detail thereof may be made without departing from the spirit and scope of the claimed invention.

I claim:

1. An apparatus for directing the flow of enamel from an enamel reservoir to a plurality of magnet wire coating dies comprising:
   - a manifold bar having an exterior surface including one flat surface;
   - an internal conduit within the manifold bar;
   - at least one supply port communicating with the internal conduit and with the exterior of the manifold bar;
   - a plurality of manifold feed passages communicating with the internal conduit and the flat surface;
   - an independently operable shutoff valve in each manifold feed passage;
   - a die bar having a flat exterior surface;
   - a plurality of the magnet wire coating dies mounted in said die bar;
   - a plurality of separate die feed passages in said die bar each in communication with a single die and the flat surface of said die bar; and
   - means for maintaining the flat surfaces of said manifold and said die bar in sealing contact with said manifold feed passages and said die feed passages in fluid communication.

2. An apparatus as in claim 1, further comprising locator pins positioned on the flat surface of the manifold bar, and cooperating recesses in the flat surface of said die bar, for aligning said die bar with said manifold bar.

* * * * *